US006640833B2

(12) United States Patent
Brocard et al.

(10) Patent No.: US 6,640,833 B2
(45) Date of Patent: Nov. 4, 2003

(54) FAIL-FREEZE SERVOVALVE

(75) Inventors: Jean-Marie Brocard, Rubelles (FR); Michel Le Texier, Epinay-sous-Senart (FR)

(73) Assignee: SNECMA Moteurs, Paris (FR)

( * ) Notice: Subject to any disclaimer, the term of this patent is extended or adjusted under 35 U.S.C. 154(b) by 0 days.

(21) Appl. No.: 10/001,976

(22) Filed: Dec. 5, 2001

(65) Prior Publication Data

US 2002/0100511 A1 Aug. 1, 2002

(30) Foreign Application Priority Data

Dec. 19, 2000 (FR) ..... 00 16564

(51) Int. Cl.[7] ..... F15B 13/043
(52) U.S. Cl. ..... 137/625.63; 137/625.64
(58) Field of Search ..... 137/625.63, 625.64

(56) References Cited

U.S. PATENT DOCUMENTS 2,964,018 A 12/1960 Farron
3,922,955 A 12/1975 Kast
4,227,443 A * 10/1980 Toot ..... 137/625.64
4,827,981 A * 5/1989 Livecchi et al. ..... 137/625.64
5,156,189 A * 10/1992 Tranovich ..... 137/625.63
5,220,861 A 6/1993 Kamimura

* cited by examiner

*Primary Examiner*—Gerald A. Michalsky
(74) *Attorney, Agent, or Firm*—Oblon, Spivak, McClelland, Maier & Neustadt, P.C.

(57) ABSTRACT

The servovalve comprises an electric motor and a distributor valve integrating a hydraulic slide under the control of said electric motor and further comprising two load channels pierced in a central rod on which blocks are mounted for co-operating with communication orifices of the distributor valve and co-operating with one another and with the ends of the hydraulic slide to define annular chambers including two load chambers connected to the receiver member to be controlled. The two load channels put each of the load chambers into communication respectively with an immediately adjacent annular chamber so as to ensure that the same pressure exists on both sides of the blocks separating said two chambers. In a predetermined safe position (referred to a "fail-freeze" position) in which the blocks close the load orifices with clearance, the leaks through the load orifices that result from the clearance are drained at determined low pressure, thus enabling the drift of the controlled member to be controlled.

7 Claims, 4 Drawing Sheets

FAIL-FREEZE SERVOVALVE

FIELD OF THE INVENTION

The present invention relates to the general field of electrohydraulic systems, and more particularly it relates to a servovalve for regulating flow rate and used in particular in an aircraft fuel injection circuit.

PRIOR ART

Conventionally, a servovalve comprises an electric motor, e.g. a torque motor, and a hydraulic distributor valve whose flow rate is controlled to be proportional to the control current applied to the electric motor. It is used in systems that are servo-controlled in position, speed, or force, so as to provide control that is fast and accurate at high levels of power.

In the aviation and aerospace fields where it is becoming more and more commonplace to use computers and electrical controls, servovalves are naturally applied to defrosting or cooling circuits, to piloting compressors, or to adjusting outlet nozzles, or indeed to circuits for injecting fuel, to mention only a few particular examples relating to aeroengines. At present, with that type of servovalve, there can be seen a need to "freeze" the position of controlled members in the event of an electrical failure in the aircraft control computer, so that after the breakdown has been found and corrected, said members remain in exactly the same state as they were before the breakdown.

"Fail-freeze" valves that remember their position are well-known to the person skilled in the art. They enable a receiver member associated with the valve to be frozen in a determined position. FIG. 8 shows an example of such a fail-freeze valve 1 associated with an electrohydraulic servovalve 2 for controlling a measurement device 3. The servovalve operates as a conventional three-port servovalve (high pressure (HP) feed 4, return 5, and load 6) together with its electric motor 7 and its hydraulic distributor valve 8 controlled by said motor and supplying a control pressure (or load pressure) for the measurement device as taken from a high pressure feed, the fail-freeze valve interposed between the servovalve and the measurement device being inactive in normal operation. In contrast, in the event of an electrical failure, the servovalve 2 actuated in the opposite direction will, via a fourth port 9, cause said position memory valve 1 to be moved immediately (position shown in FIG. 8), so as to isolate the measurement device 3 which is thus frozen in the position it occupied prior to the electrical breakdown.

Unfortunately, the above structure presents certain drawbacks. Firstly it requires an additional switching stage (also referred to as a third slide), which gives rise to problems of bulk, in particular for onboard apparatuses. Furthermore, the position-freezing action of this structure is exerted only on a single control pressure, which puts a limit on the types of receiver member to be controlled. Finally, during the transient stage between the normal positions for the slides 1 and 2, and the positions corresponding to the slides being frozen, displacement of the slide 1 (to the right in the figure) pushes the slide 3 (to the left) by an amount that corresponds to the volume moved by the slide 1 (the volume common to the chambers of the slides 1 and 3 being incompressible). This movement, even if small, can be harmful in certain applications.

OBJECT AND DEFINITION OF THE INVENTION

The present invention thus seeks to provide an electrohydraulic device that mitigates the drawbacks of the prior art. An object of the invention is to provide such a device that is simple in structure and particularly compact.

These objects are achieved by a servovalve integrating a fail-freeze function and comprising an electric motor and a distributor valve controlled by said electric motor, said distributor valve having a hydraulic slide which can move linearly inside a cylinder under drive from pressure unbalance created at the two ends of said slide by varying a controlled current for said electric motor, said hydraulic slide comprising a central rod having blocks mounted thereon for co-operating with communication orifices of said distributor valve, and said blocks co-operating with one another and with said ends of the said hydraulic slide to define annular chambers, said communication orifices including at least one high pressure feed orifice, at least one exhaust orifice, and at least two load orifices connected to a receiver member to be controlled, and said annular chambers comprising two pilot chambers, at least two high pressure chambers, at least one low pressure chamber and at least two load chambers, the servovalve further comprising, pierced in said central rod, two load channels for putting each of said load chambers into communication with an immediately adjacent annular chamber so as to ensure that the same pressure is applied on both sides of the blocks separating these two chambers, and wherein, in a predetermined safe position (known as the "fail-freeze" position) in which said blocks close said load orifices with clearance, the leaks through said load orifices that result from said clearance are drained at a determined pressure (preferably an exhaust low pressure).

Thus, with this particular structural implementation of the distributor valve of a servovalve, it is possible not only to freeze the position of the receiver member controlled by said servovalve, but also and above all significantly to reduce and control leaks and to define the direction in which said control receiver member will drift.

Preferably, the blocks closing the load orifices in said fail-freeze position are mounted with considerable overlap relative to said load orifices. Advantageously, said overlap lies in the range 1 millimeter (mm) to 5 mm.

In a preferred embodiment, the servovalve comprises a central rod provided with six blocks forming seven annular chambers including two pilot chambers situated at the two ends of the distributor valve and five communication orifices in addition to pilot orifices opening out into said pilot chambers. In a variant, the block closing one of the load orifices has two annular drain grooves at its periphery which communicate with the low pressure chamber via a third load channel pierced in the rod.

In another embodiment, the servovalve comprises a central rod provided with eight blocks forming nine annular chambers including two pilot chambers at the two ends of the distributor valve, and seven communication orifices in addition to pilot orifices opening out into said pilot chambers.

BRIEF DESCRIPTION OF THE DRAWINGS

The characteristics and advantages of the present invention appear better from the following description given by way of non-limiting indication and with reference to the accompanying drawings, in which.

DETAILED DESCRIPTION OF A PREFERRED EMBODIMENT

Figure 1:
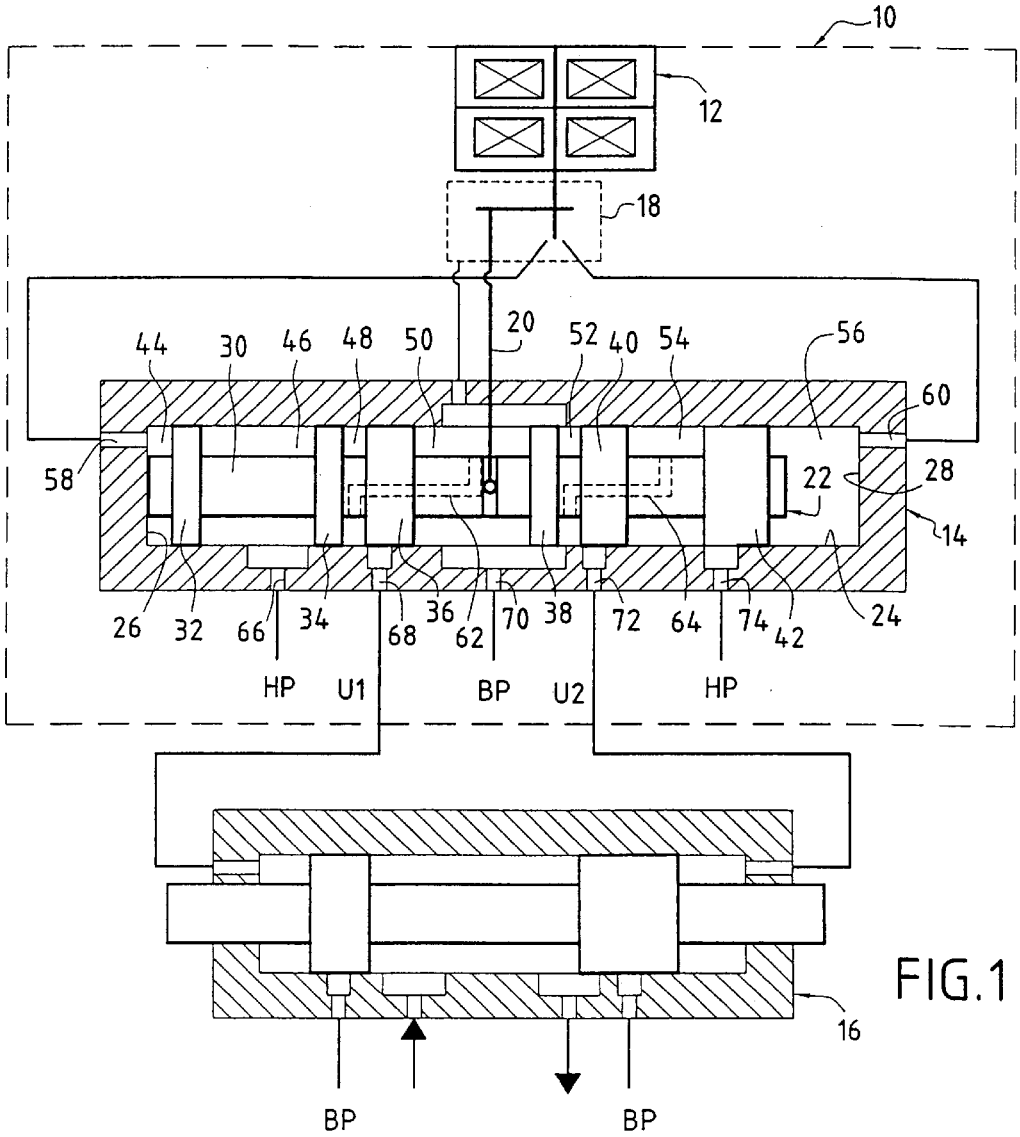
FIG. 1 is a diagrammatic view of a preferred first embodiment of a fail-freeze servovalve of the invention.
Figure 8:
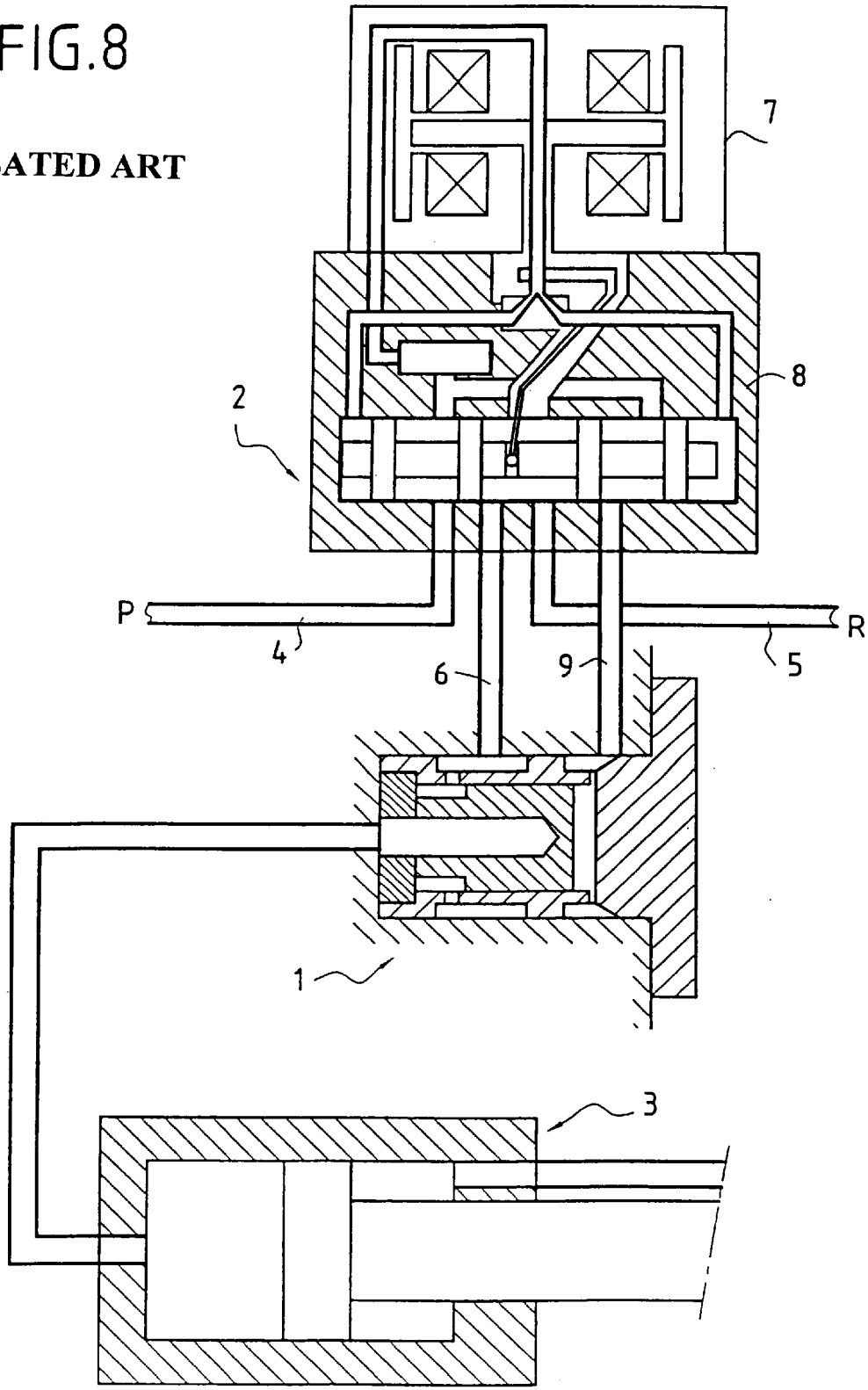
FIG.8 RELATED ART
FIG. 8 shows an example of a prior art fail-freeze valve.

FIG. 1 is highly diagrammatic and shows a preferred first embodiment of a servovalve 10 of the invention provided with its electric motor 12 and its hydraulic distributor valve 14, and intended to control a receiver member, such as a measuring circuit for fuel injection 16. The electric motor proper 12 and its associated hydromechanical elements 18 (hydraulic potentiometer and mechanical feedback 20 forming the pilot member for the distributor valve) are not directly involved with the invention and are not described in detail. They are conventional, for example they are like those of the prior art shown in FIG. 8.

The invention thus relates essentially to the distributor valve 14 which comprises a hydraulic slide 22 capable of moving linearly in an associated cylinder (or distributor valve bore) 24 under drive from a pressure unbalance applied to its two ends 26, 28 by the pilot member which is itself powered by the electric motor 12.

Figure 3:
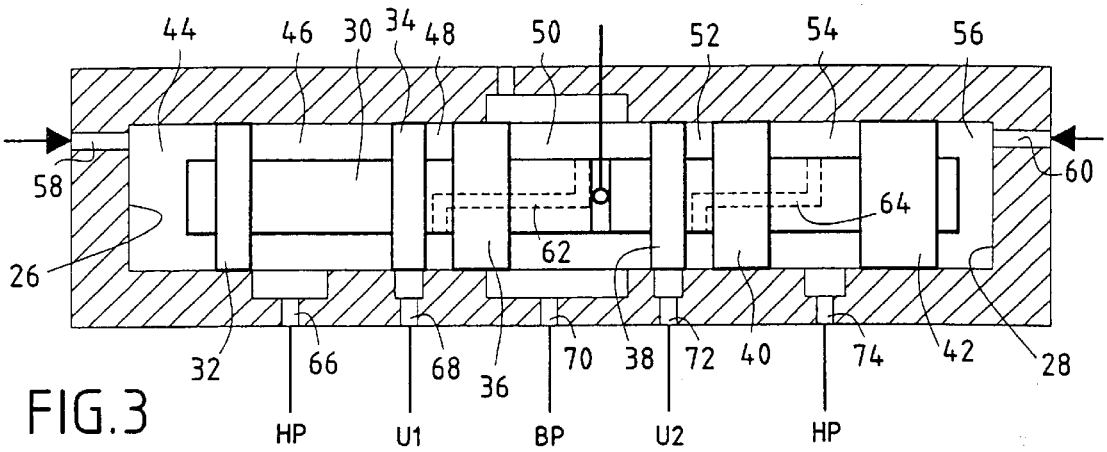
FIGS. 3 to 5 show various positions of the distributor valve of the servovalve of FIG. 1.

The slide comprises a central rod 30 having six blocks (or collars) 32–42 mounted thereon for the purpose of co-operating with communication orifices of the distributor valve and defining various annular chambers 44–56 between one another and at the ends of the slide. The two end chambers 44, 56 connected to the pilot member via orifices 58, 60 serve as pilot chambers whose pressures act in opposition to each other for controlling displacement of the slide. The term "high pressure chambers" designates the chambers 46 and 54 and the term "low pressure chamber" designates the chamber 50, said chambers being in register with corresponding communication orifices when the slide is in its equilibrium position (neutral position of FIG. 3). The two remaining chambers are referred to as "load chambers" 48, 52.

Two load channels 62, 64 are also pierced in the rod 30 of the slide so as to put these two load chambers into communication respectively with the low pressure chamber 50 for the load chamber 48 and with the two high pressure chambers 54 for the other load chamber 52.

In addition to the pilot orifices 58, 60, the distributor valve is pierced by five communication orifices 66–74 (opening out into the chambers of the distributor valve 14) each providing a connection with a respective one of the following: two high pressure (HP) feeds, an exhaust (or return to the low pressure (BP) tank), and two loads U1, U2. The exhaust orifice 70 opens out into the load pressure chamber 50 between the two load orifices 68, 72, and each high pressure feed orifice 66, 74 opens out beyond each of the load orifices.

In the position shown in FIG. 1, which is the position corresponding to the position of the controlled receiver member 16 being frozen, the slide 22 is in abutment against the end 26 of the cylinder 24 and two (36, 40) of its six blocks close the load orifices 68 and 72. Similarly, one of the high pressure orifices 74 is closed by an end block 42. In this safe position, and because of the presence of the load channels 62, 64 establishing connections respectively between the low pressure chamber 50 and the first load chamber 48, and between the high pressure chamber 54 and the second load chamber 52, a same determined level of pressure exists on both sides of each of these two blocks which, in the example shown, is the exhaust or low pressure BP. Thus, with this particular structure which prevents applying a pressure difference $\Delta P$ around the load orifices, any interfering laminar leaks that might exist past the slide (more precisely between the outer peripheral surfaces of its blocks and the inside wall of the distributor valve) are particularly small and they are drained to the low pressure exhaust. only the hydraulic forces applied to the measuring unit 16 can then generate a small pressure difference between said load orifices U1 and U2. It should also be observed that these forces tend to close the measuring orifice by pushing the slide of the measuring unit to the left.

The operation of the servovalve is described below with reference to FIGS. 2 to 5.

Figure 2:
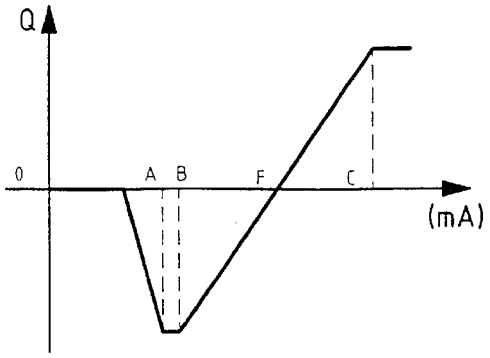
FIG. 2 is a graph showing the operating range of the FIG. 1 servovalve.

FIG. 2 is a graph showing how the outlet flow rate from the distributor valve 14 varies as a function of the control current applied to the electric motor 12 of a servovalve of the invention. It shows that the servovalve has an operating range with a zero flow rate portion (between 0 and A) and a linear operating portion (between B and C). The zero flow rate portion corresponds to the servovalve operating in fail-freeze mode, as shown above in FIG. 1.

Under steady conditions (corresponding to point F in FIG. 2) the slide 22 is in its central, equilibrium position (FIG. 3) and the load orifices U1 and U2 are closed by the two blocks. The first one (34) of these two blocks between the high pressure chamber 46 and the first load chamber 48 is subjected on one side to the high pressure feed and on the other side to a low pressure via the first load channel 62. The second one (38) of these two blocks between the low pressure chamber 50 and the second load chamber 52 is subjected on one side to a low pressure and on the other side to the high pressure feed from the orifice 74 as applied via the second load channel 64.

Under dynamic conditions, when the pilot pressure varies under the effect of an electrical command to the first stage (motor 12), the opposite forces exerted on the slide 22 no longer compensate and unbalance becomes manifest, thus moving the slide to one or other end of the distributor valve, depending on the sign of the unbalance, between two exactly opposite positions corresponding to maximum excursion of the servovalve. The drift direction depends only on the characteristics of the controlled receiver member, since in this configuration the servovalve is itself completely neutral. Whatever the state of leakage through the various clearances, they cannot give rise to any flow for moving the controlled receiver member, whereas in contrast they can be subject to a leakage flow as imposed by a controlled receiver member that is out of balance.

Figure 4:
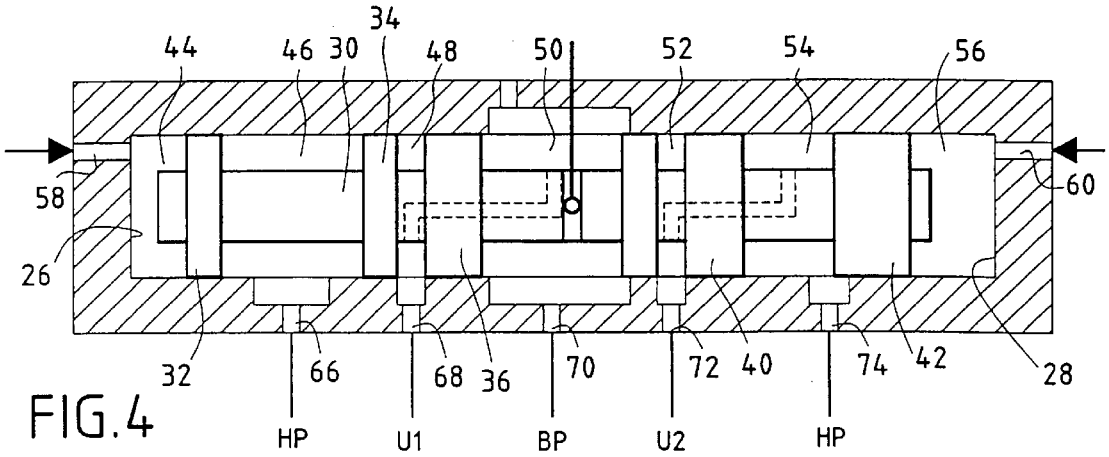
Figure 5:
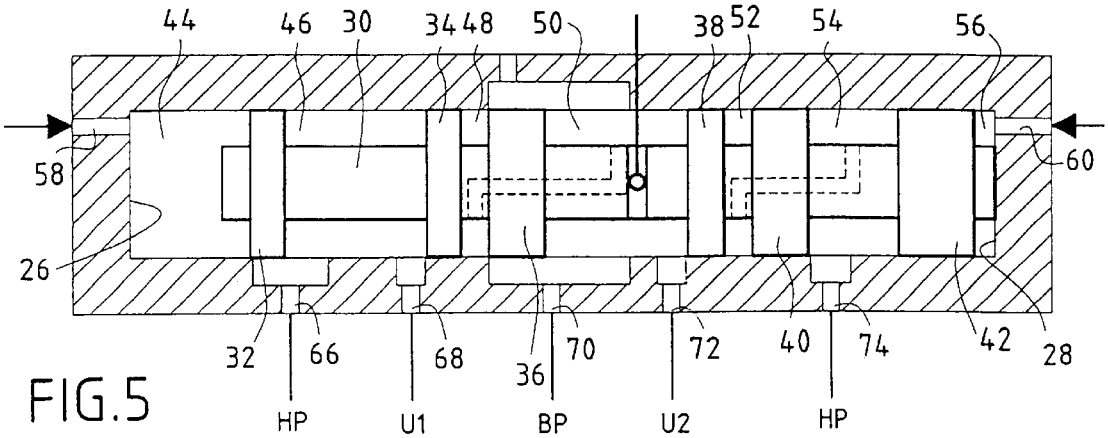

FIG. 4 shows the slide in its negative position corresponding to maximum linear operation (point B in FIG. 2). In this position, the load orifices 68 and 72 are completely free and are in direct communication with the corresponding load chambers 48, 52, which for one of them is at the feed high pressure and for the other one of them is at the exhaust low pressure. FIG. 5 shows the slide in its positive position of maximum linear operation (point C in FIG. 2). In this position, where it is in abutment against the end 28 of the cylinder 24, the load orifices 68, 72 are likewise completely free, but they are now directly in communication either with the high pressure chamber 48 or with the low pressure chamber 50.

Figure 6A:
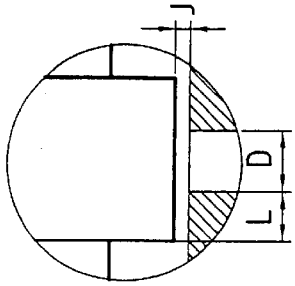
FIG. 6A is a magnified detail view showing a portion of FIG. 6.
Figure 6:
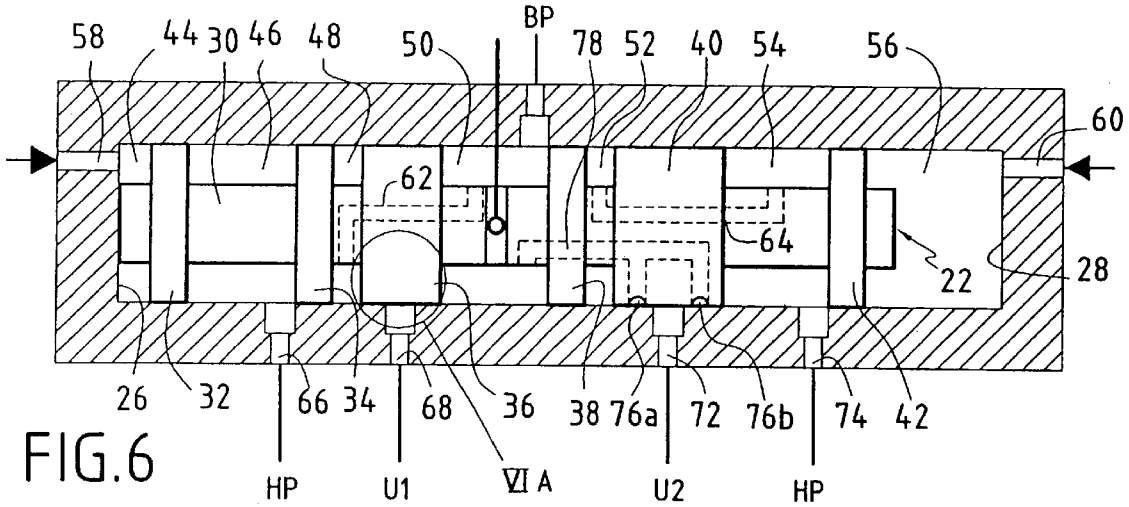
FIG. 6 is a diagrammatic view in a second embodiment of a distributor valve for a fail-freeze servovalve of the invention.

A variant embodiment of the invention is shown in FIG. 6 (with magnified detail 6A) which shows the slide 22 in its safe or "fail-freeze" position. It can be seen that its structure is quite similar to that of FIG. 1, having six blocks and seven annular chambers. Nevertheless, the end block 42 is narrower so that when it is in this position the high pressure feed orifice 74 is uncovered. As a result the load chamber 52 is at high pressure because of the second load channel 64 that exists between said chamber 52 and the high pressure chamber 54. Similarly, in this alternative embodiment, the block 40 closing the load orifice 72 is wider and has two annular drain grooves 76*a* and 76*b* in its periphery which communicate with the low pressure chamber 50 via a third load channel 78 pierced in the rod 30. Thus, as in the preferred embodiment of FIG. 1, the two load orifices 68, 72 are "surrounded" by exhaust low pressure, thus enabling fluids to be drained from these load orifices towards the low pressure.

In each of these embodiments, the leaks which are drained at exhaust low pressure from the load orifices can be adjusted accurately by appropriately dimensioning the blocks 36, 40 that close these orifices. These blocks which are of a width that cannot be increased excessively, do not cover the load orifices exactly, and a certain amount of overlap exists between them and the inside wall of the distributor valve (in prior art devices, this overlap occupies only a few hundredths of a millimeter). In the invention, this overlap is greater, being of the order of a few millimeters, preferably in the range 1 mm to 5 mm, and it is determined accurately so as to obtain determined drift of the member to be controlled. The leakage volume flow rate Q can be determined using the following formula:

$$Q = \frac{2 \times 29450 \pi J^3 \cdot \Delta P \cdot D}{\rho \cdot \nu \cdot 1}$$

where:

Q is the volume flow rate in liters per hour (l/h);

ρ is the density of the fluid in kilograms per liter (kg/l);

ν is the dynamic viscosity of the fluid, in square millimeters per second ($mm^2/s$);

D is the diameter of the orifice in mm;

J is the leakage clearance (diametral clearance of the slide) in mm;

L is the distance between the edge of the orifice and the edge of the block, in mm; and ΔP is the pressure difference applied to the leakage section, in bars.

Thus, the invention makes it possible to dimension the amplitude of leaks exactly. For example, assuming a moderate pressure difference ΔP of 2 bars, drift at a determined flow rate of 5% corresponding to a displacement of 0.14 mm in 4 minutes for a slide having a diameter of 34.7 mm can be achieved with diametral clearance of 3 μm and an overlap width of 2.6 mm for an orifice whose diameter is 0.8 mm (ρ=0.78 kg/l and ν=1 $mm^2/s$).

It should be observed that for this calculation, direct leaks between the chambers 68 and 50, or between 72 and 54, can be ignored because a very large overlap at these locations has no effect on the working stroke of the slide 22.

Figure 7:
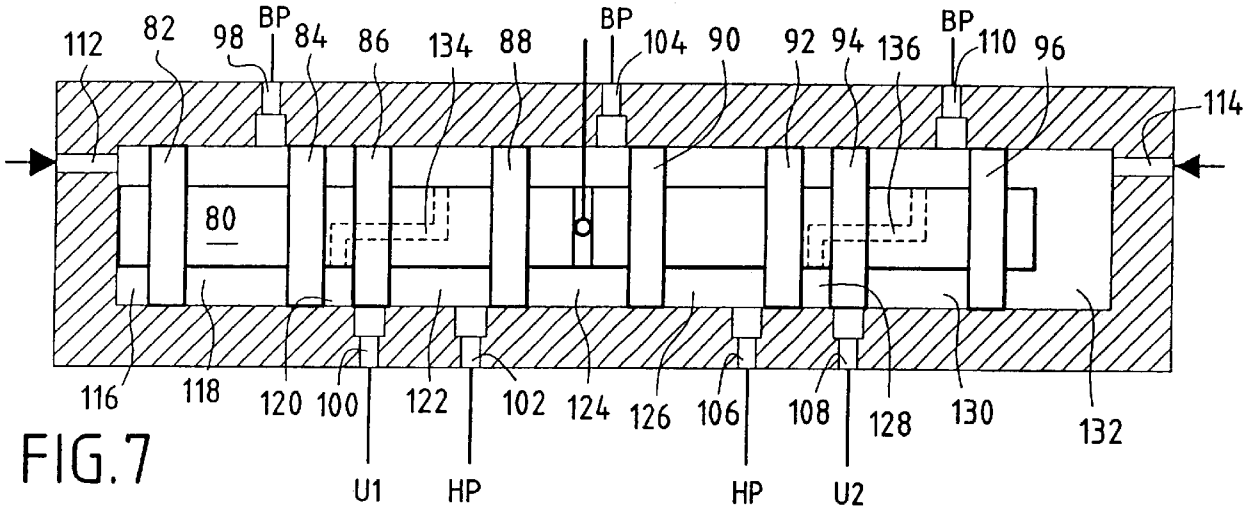
FIG. 7 is a diagrammatic view of a third embodiment of a distributor valve for a fail-freeze servovalve of the invention.

FIG. 7 shows another embodiment of the invention in which the distributor valve 14 has a rod 80 provided with eight blocks 82–96 and seven communication orifices 98–110 in addition to the usual pilot orifices 112 and 114. In this embodiment, the distributor valve thus has nine annular chambers 116–132 comprising the two pilot chambers 116 and 132 at its two ends, two high pressure chambers 122 and 126, three low pressure chambers 118, 124, 130, and two load chambers 120, 128. A first exhaust orifice 104 opens out between the high pressure feed orifices 102, 106 themselves opening out between the two load orifices 100, 108. Finally, two other exhaust orifices 98, 110 open out beyond each of the load orifices.

The position of the slide shown in FIG. 7 is the position which corresponds to the servovalve being in its fail-freeze position. Thus, the load orifice 100 and 108 are closed by blocks 86 and 94 each having both sides subjected to the same determined pressure. For one of the blocks, 94, this is the exhaust low pressure present in the first low pressure chamber 130, and in the first load chamber 128 as transmitted via a first load channel 136 pierced in the rod 80 between these two chambers, and for the other block, 86, this is the feed high pressure present in the first high pressure chamber 122 and in the second load chamber 120 transmitted via second load channel 134 pierced in the rod 80 between these two chambers. The distributor valve in this embodiment operates analogously to that described above with the slide moving in one direction or the other depending on the pressure unbalance to which it is subjected. The blocks 86 and 94 can be dimensioned so as to manage the amplitude of the drift of the controlled received member 16, with the direction of this drift (from high pressure towards the exhaust) being determined by the pressure level present on each of these two blocks. Unlike the preceding embodiments, the servovalve is thus completely biased and generates a leakage flow going from U1 to U2 regardless of the amount of leakage through the various clearances. This makes it possible to determine how the controlled member will move.

What is claimed is:

1. A servovalve comprising an electric motor and a distributor valve controlled by said electric motor, said distributor valve having a hydraulic slide which can move linearly inside a cylinder under drive from pressure unbalance created at the two ends of said slide by varying a controlled current for said electric motor, said hydraulic slide comprising a central rod having blocks mounted thereon for co-operating with communication orifices of said distributor valve, and said blocks co-operating with one another and with said ends of the said hydraulic slide to define annular chambers, said communication orifices including at least one high pressure feed orifice, at least one exhaust orifice, and at least two load orifices connected to a receiver member to be controlled, and said annular chambers comprising two pilot chambers, at least two high pressure chambers, at least one low pressure chamber, and at least two load chambers, the servovalve further comprising, pierced in said central rod, two load channels for putting each of said load chambers into communication with an immediately adjacent annular chamber so as to ensure that the same pressure is applied on both sides of the blocks separating these two chambers, and wherein, in a predetermined safe position (known as the "fail-freeze" position) in which said blocks close said load orifices with clearance, the leaks through said load orifices that result from said clearance are drained at a determined pressure.

2. A servovalve according to claim 1, wherein said determined pressure is an exhaust low pressure.

3. A servovalve according to claim 1, wherein said blocks closing said load orifices in said safe position are mounted with considerable overlap relative to said load orifices.

4. A servovalve according to claim 3, wherein said overlap lies in the range 1 mm to 5 mm.

5. A servovalve according to claim 1, comprising a central rod provided with six blocks forming seven annular chambers including two pilot chambers situated at the two ends of the distributor valve and five communication orifices in addition to pilot orifices opening out into said pilot chambers.

6. A servovalve according to claim 5, wherein the block closing one of the load orifices has two annular drain grooves at its periphery which communicate with the low pressure chamber via a third load channel pierced in the rod.

7. A servovalve according to claim 1, comprising a central rod provided with eight blocks forming nine annular chambers including two pilot chambers at the two ends of the distributor valve, and seven communication orifices in addition to pilot orifices opening out into said pilot chambers.

* * * * *